US010859253B2

(12) United States Patent
Benton et al.

(10) Patent No.: US 10,859,253 B2
(45) Date of Patent: Dec. 8, 2020

(54) DOOR FOR A DISHWASHER APPLIANCE

(71) Applicant: Haier US Appliance Solutions, Inc., Wilmington, DE (US)

(72) Inventors: Brittany Benton, Louisville, KY (US); Andrew Spanyer, Louisville, KY (US); Neil Vincenti, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 342 days.

(21) Appl. No.: 15/877,616

(22) Filed: Jan. 23, 2018

(65) Prior Publication Data

US 2019/0226673 A1 Jul. 25, 2019

(51) Int. Cl.

| | |
|---|---|
| ***F21V 33/00*** | (2006.01) |
| ***A47L 15/42*** | (2006.01) |
| ***F21Y 115/10*** | (2016.01) |

(52) U.S. Cl.

CPC ..... *F21V 33/0044* (2013.01); *A47L 15/4265* (2013.01); *A47L 15/4293* (2013.01); *F21Y 2115/10* (2016.08)

(58) Field of Classification Search

CPC ..... F21V 33/0044; A47L 15/4265; A47L 15/4293; F21Y 2115/10; F21W 2131/305; F25D 27/00; F25D 23/028

USPC ..... 362/91

See application file for complete search history.

(56) References Cited

U.S. PATENT DOCUMENTS

| | | | | |
|---|---|---|---|---|
| 7,770,985 | B2 | 8/2010 | Davis et al. | |
| 8,567,976 | B2 | 10/2013 | Hamlin et al. | |
| 8,810,423 | B2 | 8/2014 | Kaczmarek et al. | |
| 2006/0049188 | A1* | 3/2006 | Gramlich | F24C 15/04 219/723 |
| 2010/0310887 | A1 | 12/2010 | Kim et al. | |
| 2013/0027214 | A1* | 1/2013 | Eng | G02B 6/0073 340/654 |
| 2016/0186984 | A1 | 6/2016 | Giacomini et al. | |

FOREIGN PATENT DOCUMENTS

| | | | |
|---|---|---|---|
| CN | 203576456 | U | 5/2014 |
| CN | 204427974 | U | 7/2015 |
| EP | 826489 | B1 | 11/1998 |
| EP | 2843329 | A2 | 3/2015 |
| WO | WO2014177226 | A1 | 10/2017 |

* cited by examiner

*Primary Examiner* — Cara E Rakowski
*Assistant Examiner* — Jessica M Apenteng
(74) *Attorney, Agent, or Firm* — Dority & Manning, P.A.

(57) ABSTRACT

A door for a dishwasher appliance is provided herein. The dishwasher door may include an internal panel, an external panel, and a light source. The internal panel may define an inner face and an outer face. The internal panel may define a light channel from the inner face to the outer face. The external panel may extend across the internal panel in front of the light channel. The external panel may define an inner face directed toward the outer face of the planner internal panel. The light source may be positioned behind the internal panel. The light source may be directed at the light channel.

17 Claims, 9 Drawing Sheets

DOOR FOR A DISHWASHER APPLIANCE

FIELD OF THE INVENTION

The present subject matter relates generally to dishwasher appliances and more particularly to dishwasher doors having a visual indicator.

BACKGROUND OF THE INVENTION

Dishwasher appliances generally include a tub that defines a wash chamber for receipt of articles for washing. A door provides for selective access to the wash chamber. For example, the door can be rotatably mounted to the wash tub with a hinge. The door can selectively adjust between an open and a closed position by rotating about the hinge in order to permit access to the wash chamber.

In existing appliances, one or more lights are often provided with a control panel as part of a discrete attachment or assembly mounted to a front portion of the door. By illuminating, the lights may generally communicate relevant information regarding the dishwasher appliance. Such lights may be useful in providing information, but can be unsightly or undesirable, especially when the lights are not illuminated. For instance, the lights may extend forward from the rest of the door or assembly, interrupting an otherwise smooth surface. Moreover, a user may be able to see where the light is positioned, even when the light is not illuminated. Such visual disruptions may cheapen the appearance and perceived quality of the dishwasher appliance. Moreover, the visibility of the light when unilluminated may be distracting and hinder the efficacy of light. For instance, a user may take less notice of the light when illuminated because the light is visible even when unilluminated. Furthermore, the visibility of the unilluminated light may cause confusion for a user, who might believe that the light is intended to be a button that can be depressed (e.g., in order to control the dishwasher).

As a result, further improvements for dishwasher doors may be desirable. In particular, it would be advantageous to provide a door with a visual indicator that would not cause confusion and could enhance the efficacy thereof.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dishwasher door is provided. The dishwasher door may include an internal panel, an external panel, and a light source. The internal panel may define an inner face and an outer face. The internal panel may define a light channel along a transverse direction from the inner face to the outer face. The external panel may extend across the internal panel in front of the light channel. The external panel may define an inner face directed toward the outer face of the planner internal panel. The light source may be positioned behind the internal panel. The light source may be directed at the light channel to transmit a light emission therethrough.

In another exemplary aspect of the present disclosure, a dishwasher door is provided. The dishwasher door may include an internal panel, an external panel, a light source, and a light guide. The internal panel may define an inner face and an outer face. The internal panel may define a light channel at an upper portion of the door. The light channel may extend along a transverse direction from the inner face to the outer face. The external panel may extend across the internal panel in front of the light channel. The external panel may define an inner face directed toward the outer face of the planner internal panel. The light source may be positioned behind the internal panel. The light source may be directed at the light channel to transmit a light emission therethrough. The light guide may extend through the light channel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
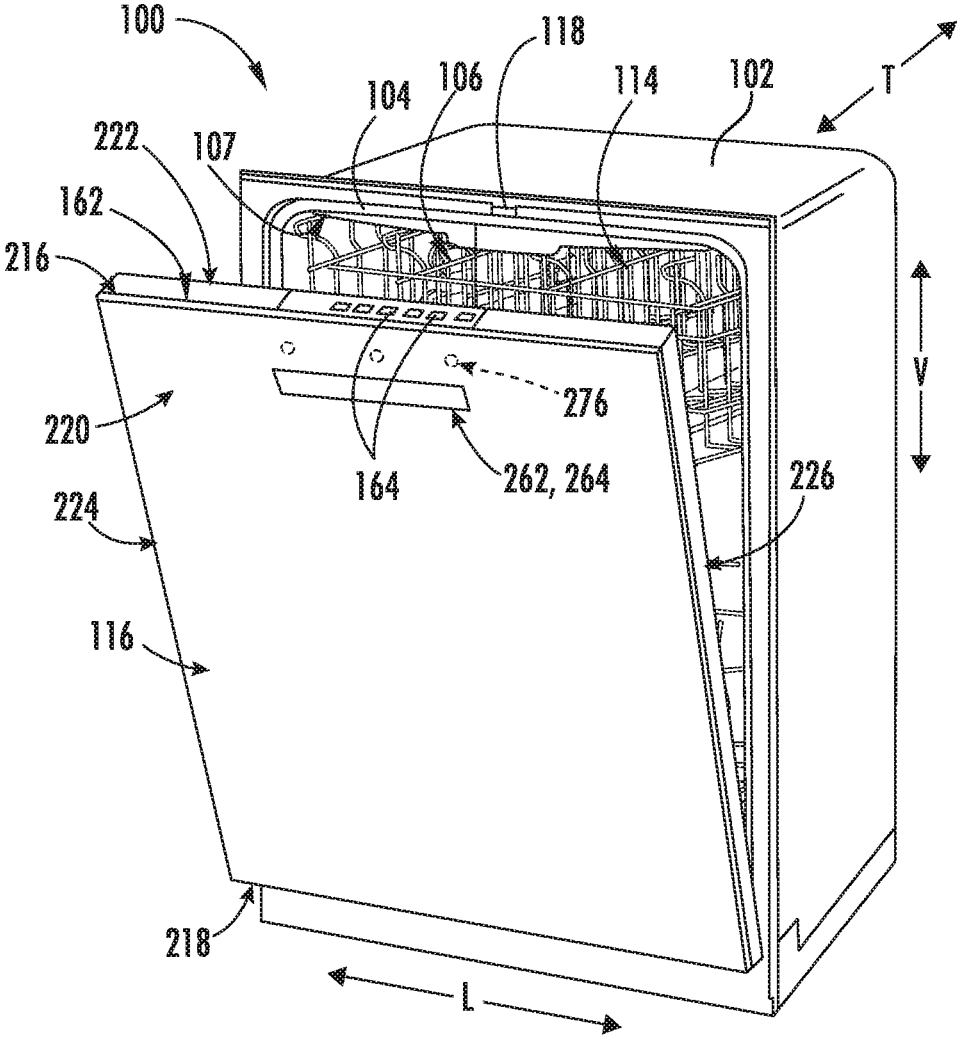
FIG. 1 provides a perspective view of a dishwasher appliance, including a dishwasher door according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "includes" and "including" are intended to be inclusive in a manner similar to the term "comprising." Similarly, the term "or" is generally intended to be inclusive (i.e., "A or B" is intended to mean "A or B or both"). The phrase "in one embodiment," does not necessarily refer to the same embodiment, although it may. Furthermore, as used herein, terms of approximation, such as "approximately," "substantially," or "about," refer to being within a ten percent margin of error.

Figure 2:
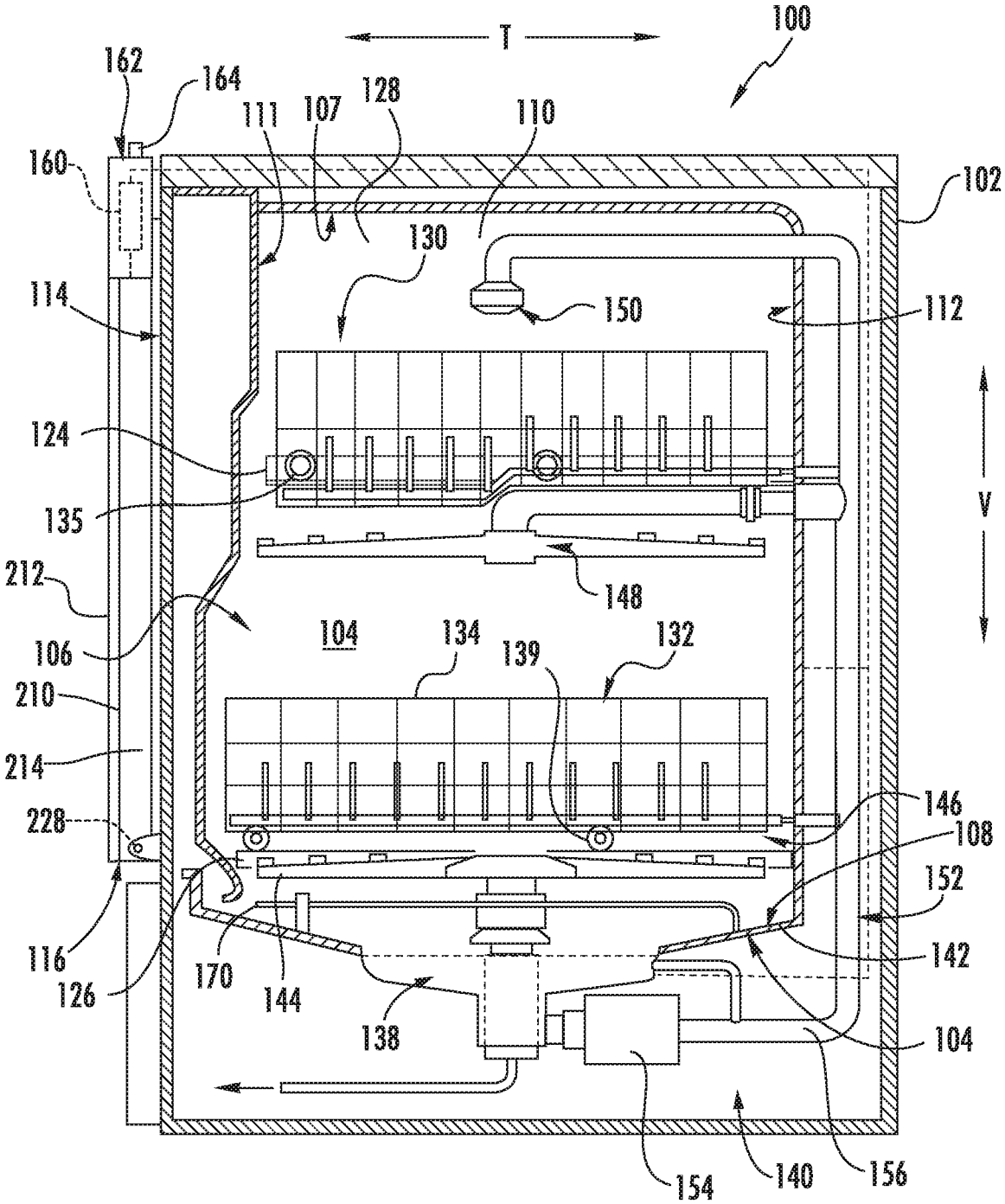
FIG. 2 provides a cross-sectional side view of the exemplary dishwashing appliance of FIG. 1.

FIGS. 1 and 2 depict an exemplary domestic dishwasher or dishwashing appliance 100 that may be configured in accordance with aspects of the present disclosure. Dishwasher appliance 100 generally includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another and form an orthogonal direction system.

The tub 104 includes a front opening 114. A door 116 may be provided for selectively covering the opening 114. For example, door 116 may be hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As illustrated in FIG. 2, tub side walls 110 may accommodate one or more rack assemblies. Upper and lower guide rails 124, 126 are mounted on tub side walls 110 and accommodate roller-equipped rack assemblies 130 and 132. In optional embodiments, each of the rack assemblies 130, 132 is fabricated as a lattice structure including a plurality of elongated members 134 (for clarity of illustration, not all elongated members forming assemblies 130 and 132 are shown in FIG. 2). Each rack 130, 132 is adapted for movement between an extended loading position (not shown), in which the rack is substantially positioned outside the wash chamber 106, and a retracted position (shown in FIGS. 1 and 2), in which the rack is located inside the wash chamber 106. This rack movement may be facilitated by rollers 135 and 139 that are, for example, mounted onto racks 130 and 132, respectively. A silverware basket (not shown) may be removably attached to rack assembly 132 for placement of silverware, utensils, and the like that are otherwise too small to be accommodated by the racks 130, 132.

In some embodiments, the dishwasher appliance 100 further includes a lower spray-arm assembly 144 that is rotatably mounted within a lower region 146 of the wash chamber 106 and above a tub sump portion 142 so as to rotate in relatively close proximity to rack assembly 132. In exemplary embodiments, such as the embodiment of FIGS. 1 and 2, one or more elevated spray assemblies 148, 150 are provided above the lower spray-arm assembly 144. For instance, a mid-level spray-arm assembly 148 is located in an upper region of the wash chamber 106 and may be located in close proximity to upper rack 130. Additionally or alternatively, an upper spray assembly 150 may be located above the upper rack 130.

The various spray assemblies and manifolds described herein may be part of a fluid distribution system or fluid circulation assembly 152 for circulating water and wash fluid in the tub 104. More specifically, fluid circulation assembly 152 includes a pump 154 for circulating water and wash fluid (e.g., detergent, water, or rinse aid) in the tub 104. Pump 154 may be located within sump 138 or within a machinery compartment located below sump 138 of tub 104, as generally recognized in the art. Fluid circulation assembly 152 may include one or more fluid conduits or circulation piping for directing water or wash fluid from pump 154 to the various spray assemblies and manifolds. For example, as illustrated in FIG. 2, a primary supply conduit 156 may extend from pump 154, along rear 112 of tub 104 along the vertical direction V to supply wash fluid throughout wash chamber 106.

As illustrated, primary supply conduit 156 is used to supply wash fluid to one or more spray assemblies (e.g., assemblies 144, 148, 150). However, it should be appreciated that according to alternative embodiments, any other suitable plumbing configuration may be used to supply wash fluid throughout the various spray manifolds and assemblies described herein.

A heater 170 can be used to provide heat during, e.g., a wash, rinse, or drying cycle. Optionally, heater 170 may be a resistive heating element, such as a type sold under the name CALROD®. Additionally or alternatively, an inline heating element may be provided within fluid circulation assembly 152 to provide heat to wash fluid flowing therethrough.

Each spray-arm assembly 144, 148 includes an arrangement of discharge ports or orifices for directing washing fluid received from the recirculation pump 154 onto dishes or other articles located in rack assemblies 130 and 132. The arrangement of the discharge ports in spray-arm assemblies 144, 148 may provide a rotational force by virtue of washing fluid flowing through the discharge ports. The resultant rotation of the spray-arm assemblies 144, 148 and the operation of the spray assembly 150 using fluid from the recirculation pump 154 provides coverage of dishes and other dishwasher contents with a washing spray. Other configurations of spray assemblies may be used as well.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel or controls 164 through which a user may select various operational features and modes and monitor progress of the dishwasher 100. In some embodiments, the user interface 164 represents a general purpose I/O ("GPIO") device or functional block. In additional or alternative embodiments, the user interface 164 includes input components, such as one or more of a variety of electrical, mechanical or electromechanical input devices including rotary dials, push buttons, and touch pads. As shown, one or more user inputs (e.g., buttons) of user interface 164 may be positioned at a top end 216 of door 116 (e.g., on or through a top wall of door 116). The user interface 164 may include a display component, such as a digital or analog display device designed to provide operational feedback to a user. The user interface 164 may be in communication with the controller 160 via one or more signal lines or shared communication busses.

It should be appreciated that the present disclosure is not limited to any particular style, model, or configuration of dishwasher. The exemplary embodiment depicted in FIGS. 1 and 2 is for illustrative purposes only. For example, different locations may be provided for user interface 164, different configurations may be provided for racks 130, 132, and other differences may be applied as well.

Turning now to FIGS. 3 through 6, a door 116 according to exemplary embodiments of the present disclosure are provided. As described above, it is understood that, door 116 may be mounted on dishwasher appliance 100 (FIG. 1). In turn, the mutually-orthogonal vertical direction V', lateral direction L', and transverse direction T' defined by door 116 and discussed below may be coaxial or otherwise parallel to the vertical direction V, lateral direction L, and transverse direction T, respectively (e.g., when door 116 is in the closed position).

As shown, door 116 includes a plurality of panels (e.g., panel 210 and panel 212) attached to an inner frame 214. Generally, inner frame 214 extends from a top end 216 to a bottom end 218 along the vertical direction V'; from a front end 220 to a rear end 222 along the transverse direction T'; and between two lateral ends 224, 226 along the lateral direction L'. A pivot axis 228 may be defined on inner frame 214 (e.g., by one or more lateral pivot hinges or pins), for example, at or proximal to bottom end 218.

When assembled, inner frame 214 is positioned behind the plurality of panels 210, 212 (e.g., along the transverse direction T'). The panels 210, 212 may thus be positioned on front end 220 distal to opening 114 (FIG. 2) while an inner surface of rear end 222 is positioned proximate to opening 114 [e.g., to define a transverse extreme of chamber 106 (FIG. 2) in the closed positioned]. Optionally, some or all of the inner surface of rear end 222 may be formed from a molded plastic or metal sheet, as would be generally understood. Additionally or alternatively, some or all of the inner surface of rear end may be formed from another suitable material, such as glass or wood. The plurality of panels 210, 212 may be fixed to inner frame 214 such that panels 210, 212 rotate with inner frame 214 as door 116 moves between the open and closed positions.

Figure 3:
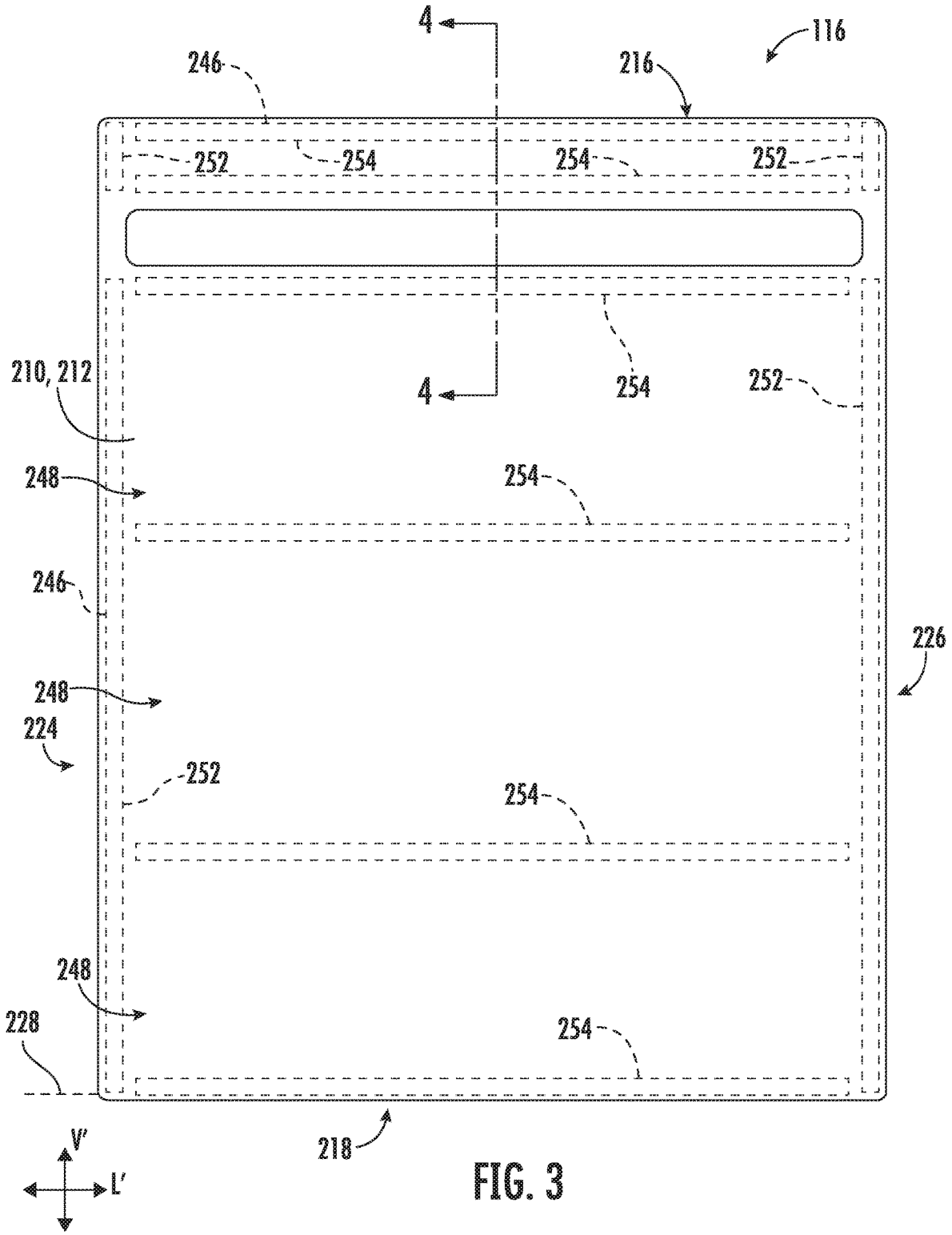
FIG. 3 provides a front perspective view of a dishwasher door according to exemplary embodiments of the present disclosure.
Figure 4:
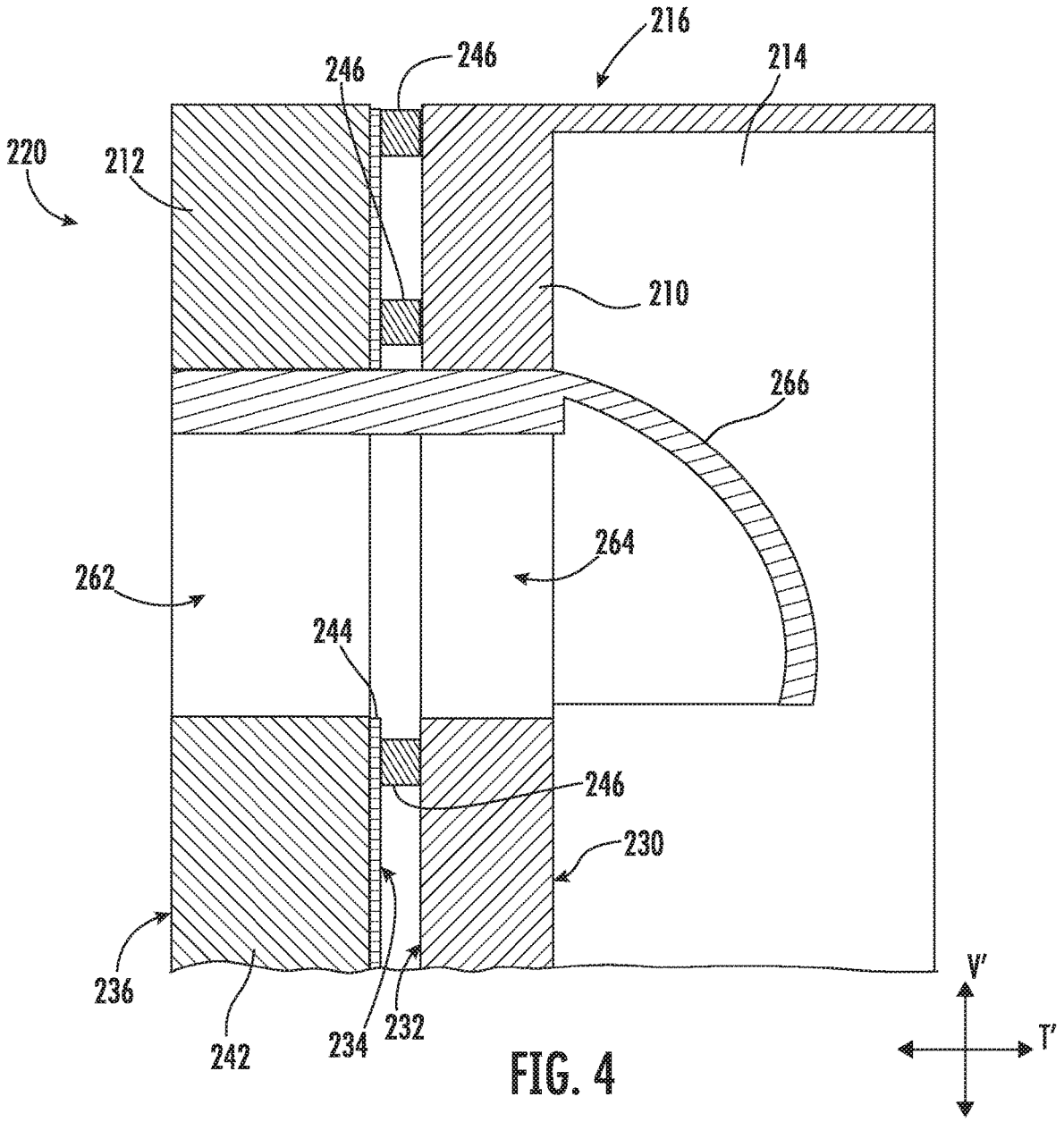
FIG. 4 provides a cross-sectional side view of a top portion of a dishwasher door according to exemplary embodiments of the present disclosure.
Figure 6:
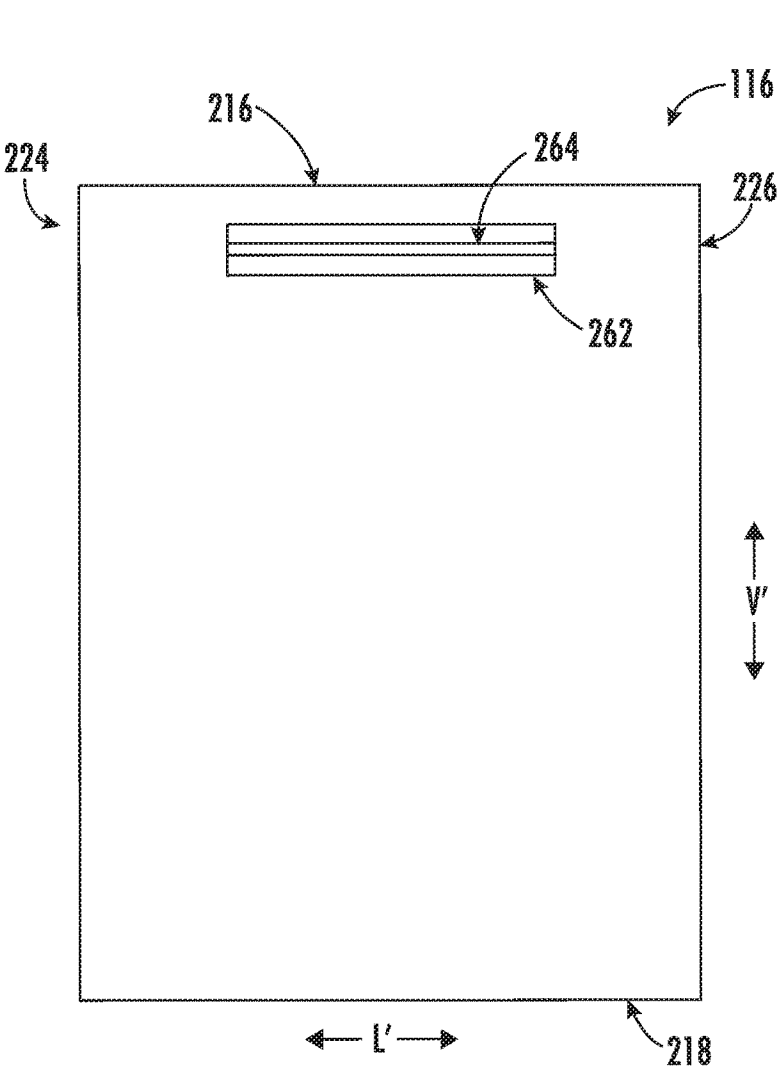
FIG. 6 provides a front perspective view of the exemplary dishwasher door of FIG. 5.

Turning especially to FIGS. 3 and 4, the plurality of panels includes a discrete internal panel 210 and external panel 212. As shown, internal panel 210 defines a pair of opposite (e.g., parallel) faces. In some such embodiments, internal panel 210 and external panel 212 are each provided as planar members. Generally, internal panel 210 defines an inner face 230 and an outer face 232 spaced apart along the transverse direction T'. Inner face 230 may be directed toward the inner frame 214 while outer face 232 is directed away from inner frame 214 (e.g., toward external panel 212). In some embodiments, internal panel 210 extends from first lateral end 224 to second lateral end 226. For instance, inner face 230 and outer face 232 may extend in parallel between first lateral end 224 and second lateral end 226. Thus, internal panel 210 may span the entire lateral length of door 116. In additional or alternative embodiments, internal panel 210 extends from top end 216 to bottom end 218. For instance, inner face 230 and outer face 232 may extend in parallel between top end 216 and bottom end 218. Thus, internal panel 210 may span the entire vertical length of door 116 (e.g., below user inputs or control panel 164—FIG. 2).

Internal panel 210 may be formed from any suitable material, such as a plastic or metal material (e.g., stainless steel, galvanized steel, aluminum, etc.). When assembled, internal panel 210 may be attached (e.g., directly or indirectly fixed) to inner frame 214. Optionally, internal panel 210 may be a single integral pane or member, as shown in FIGS. 3 through 6. Additionally or alternatively, internal panel 210 may be integrally formed with at least a portion of inner frame 214 (e.g., at a front end of inner frame 214). Thus, internal panel 210 may contribute to or increase the structural rigidity of inner frame 214.

Generally, external panel 212 is positioned in front of internal panel 210 (e.g., along the transverse direction T'). As shown, external panel 212 defines a pair of opposite (e.g., parallel) faces. In particular, external panel 212 defines an inner face 234 and an outer face 236 spaced apart from each other along the transverse direction T'. Inner face 234 may be directed toward internal panel 210 (e.g., toward outer face 232 of internal panel 210) while outer face 236 is directed away from internal panel 210 (e.g., toward an ambient environment in front of door 116). In some such embodiments, outer face 236 of external panel 212 defines an outermost surface of the door 116 along the transverse direction T', as shown. When assembled, external panel 212 is positioned across internal panel 210 from first lateral end 224 to second lateral end 226. For example, external panel 212 may define a footprint that covers internal panel 210 in a plane perpendicular to the transverse direction T' (e.g., in the vertical direction V' and the lateral direction L'). Moreover, inner face 234 and outer face 236 may extend in parallel between first lateral end 224 and second lateral end 226. Thus, external panel 212 may span the entire lateral length of door 116. Outer face 236 of external panel 212 may advantageously form an unbent edge-to-edge surface in the lateral direction L'. In additional or alternative embodiments, external panel 212 extends from top end 216 to bottom end 218. For instance, inner face 234 and outer face 236 may extend in parallel between top end 216 and bottom end 218. Thus, internal panel 210 may span the entire vertical length of door 116 (e.g., below user inputs or control panel 164).

External panel 212 may be formed from one or more suitable unbent material, such as a plastic material (e.g., acrylic, polycarbonate, etc.) or ceramic material (e.g., glass or glass-ceramic). As shown, in particular at FIG. 4, some embodiments of external panel 212 may be (or may include) an optically transparent pane 242. The optically transparent pane 242 may be generally solid or non-porous (e.g., such that water is not permitted to pass through a solid body portion of the external panel 212). For instance, optically transparent pane 242 may be a transparent glass sheet extending from first lateral end 224 to second lateral end 226. Moreover, optically transparent pane 242 may define the outer face 236 of external panel 212 as a flat smooth surface. Notably, the edge-to-edge surface of the door 116 may permit a user to see through external panel 212 (e.g., to internal panel 210 behind external panel 212). Additionally or alternatively, external panel 212 may define an outermost surface that advantageously resists the accumulation of foreign materials (e.g., dirt, grease, etc.) and is relatively easy to clean.

In some such embodiments, the internal panel 210 is viewable through the optically transparent pane 242. In additional or alternative embodiments, an opaque coating 244 is included with external panel 212. For instance, as shown in FIG. 4, opaque coating 244 may be positioned on the inner face 234 of external panel 212. Thus, opaque coating 244 may be between the outer face 232 of internal panel 210 and the outer face 236 of the external panel 212. Optionally, opaque coating 244 may extend across the entire inner face 234 of external panel 212 or, alternatively, only a portion thereof. Opaque coating 244 may any suitable material or finish applied to the inner face 234, such as, for example, an applied paint, vinyl or plastic cutout, resin, etc.

As shown, a mounting element, such as an adhesive layer or film 246, may be positioned between internal panel 210 and external panel 212 (e.g., along the transverse direction T', along the edges of panels 210 and 212, or at another suitable location). Additionally or alternatively, any suitable mounting element may be provided to join panels 210 and 212, as would be generally understood. As illustrated, in some embodiments, adhesive layer 246 contacts both panels 210, 212 and holds the panels 210, 212 together. When assembled, adhesive layer 246 forms a first bond with internal panel 210 and a second bond with external panel 212. In particular, the first bond is formed on the outer face 232 of internal panel 210, while the second bond is formed on the inner face 234 of external panel 212 (e.g., against the optically transparent pane 242 or opaque coating 244). In some embodiments, adhesive layer 246 is the only means of attachment securing external panel 212 to internal panel 210. Advantageously, an uninterrupted and unbent edge-to-edge surface may be formed on door 116.

Generally, adhesive layer 246 may be any suitable applied adhesive material. In certain embodiments, adhesive layer 246 is an applied fluid adhesive, such as a silicone rubber [e.g., a two-part Room-Temperature Vulcanizing (RTV) silicone]. In additional or alternative embodiments, adhesive layer 246 is an applied strip or tape adhesive, such as, an acrylic adhesive having an adhesive foam core (e.g., 3M VHB 5952™). Optionally, the adhesive layer 246 may be optically transparent or translucent between external panel 212 and internal panel 210 (e.g., such that internal panel 210 is visible through external panel 212 and adhesive layer 246).

Turning to FIG. 3 in particular, in some embodiments, adhesive layer 246 frames one or more open regions 248 between external panel 212 (FIG. 4) and internal panel 210 (FIG. 4). For instance, one or more vertical segments 252 of adhesive layer 246 may extend along the lateral edge of first lateral end 224 (e.g., parallel thereto). One or more other vertical segments 252 of adhesive layer 246 may extend along the lateral edge of second lateral end 226 (e.g., parallel thereto). Between the lateral edges, one or more open regions 248 may be defined. In other words, the vertical segments 252 may bound at least one open region 248 in the lateral direction L'. Additionally or alternatively, one or more horizontal segments 254 of adhesive layer 246 may extend between the lateral edges, and thereby between the ends 224, 226. One horizontal segment 254 may extend along the vertical edge of top end 216 (e.g., parallel thereto). Another horizontal segment 254 may extend along the opposite vertical edge of bottom end 218 (e.g., parallel thereto). In some embodiments, the horizontal segments 254 may thus bound at least one open region 248 in the vertical direction V'. Moreover, one or more intermediate horizontal segments 254 may be positioned between the opposite horizontal segments 254 at top end 216 and bottom end 218.

Figure 5:
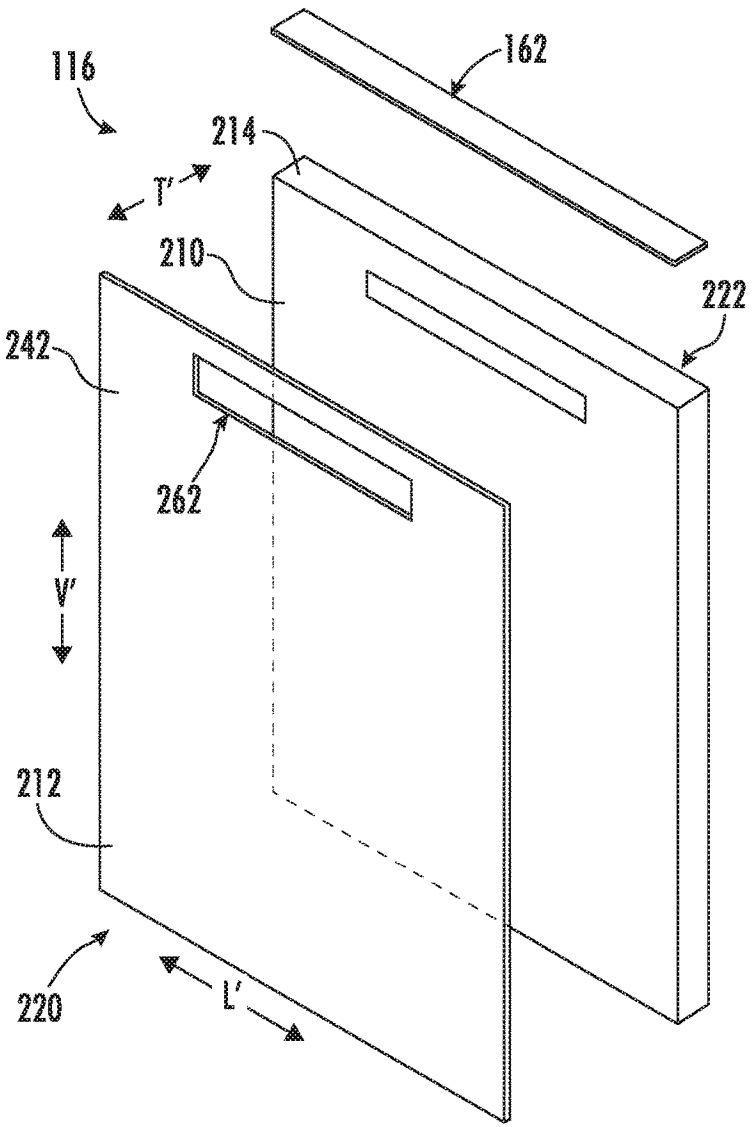
FIG. 5 provides an exploded view of a dishwasher door according to exemplary embodiments of the present disclosure.

As shown in FIGS. 3 through 6, especially at FIGS. 4 and 5, in certain embodiments, external panel 212 is a single integral pane or member (e.g., a single monolithic glass panel). The single integral pane or member may be substantially solid (such that water is prevented from passing therethrough). Additionally or alternatively, an opaque coating 244 may be present thereon, as described above. Although external panel 212 may substantially solid, one or more specific openings may be defined through the solid integral body. For instance, a front pocket handle opening 262 may be defined through the external panel 212. A rear pocket handle opening 264 may be similarly defined through internal panel 210 and matched to the front pocket handle opening 262. Optionally, one pair of vertical segments 252 or a pair of horizontal segments 254 of adhesive layer 246 may be positioned above pocket handle openings 262, 264, while another pair of vertical segments 252 or pair of horizontal segments 254 of adhesive layer 246 may be positioned below pocket handle openings 262, 264.

As shown, both pocket handle openings 262, 264 may be aligned (e.g., along the transverse direction T'). Moreover, both pocket handle openings 262, 264 may define similar or identical profiles (e.g., in a plane perpendicular to transverse direction T') to permit a user's hand to pass therethrough. Thus, the matched pocket handle openings 262, 264 may permit a user to grasp and rotate door 116. Notably, the rotation is permitted without requiring a protruding handle member. Optionally, one or more hand guards 266 may be transversely aligned with pocket handle openings 262, 264 and mounted to door 116 (e.g., held through matched pocket handle openings 262, 264).

Figure 8:
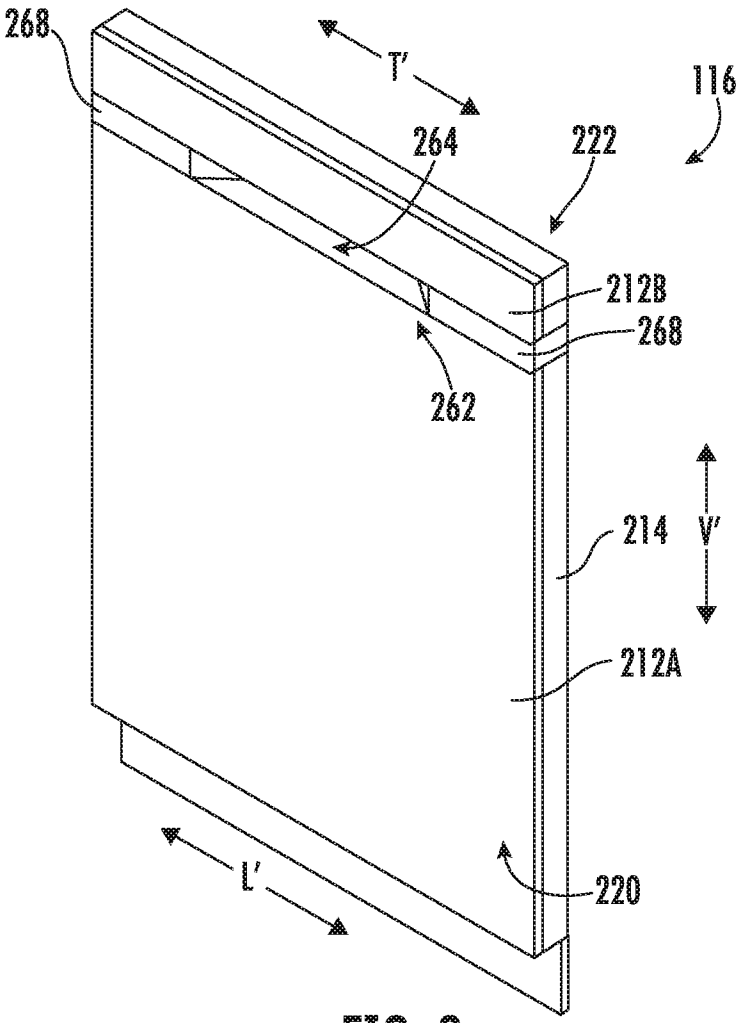
FIG. 8 provides a perspective view of the exemplary dishwasher door of FIG. 7.
Figure 7:
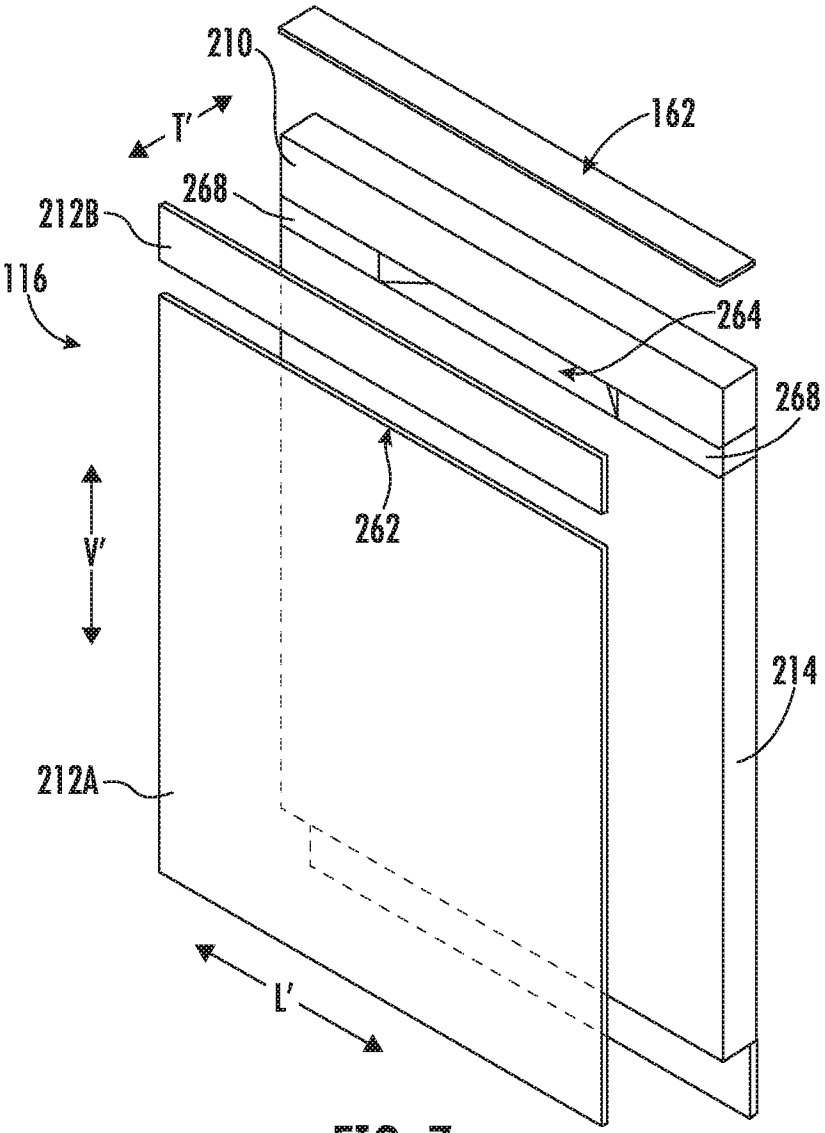
FIG. 7 provides an exploded view of a dishwasher door according to other exemplary embodiments of the present disclosure.

Turning now to FIGS. 7 and 8, various views of door 116 according to other exemplary embodiments are illustrated. Except as otherwise indicated, it is understood that the embodiments of FIGS. 7 and 8 may include all or some of the features of the embodiments described above with respect to FIGS. 1 through 6. For instance, external panel 212 may a plurality of discrete panes (e.g., a pair of glass panels). In the exemplary embodiments of FIGS. 7 and 8, the discrete panes include a first pane 212A and a second pane 212B spaced apart from first pane 212A in the vertical direction V' (e.g., above first pane 212A). One or more spacer bodies 268 may be fixed to internal panel 210 (e.g., integral with internal panel 210, or extending therefrom along the transverse direction T') and separate the first and second panes 212A, 212B. When assembled, the discrete panes 212A, 212B may be aligned in parallel along the vertical direction V'.

In some such embodiments, door 116 defines a pair of matched pocket handle openings 262, 264 through the external panel 212 and the internal panel 210. In particular, front pocket handle opening 262 may be defined by the separation or spacing between the first and second panes 212A, 212B along the vertical direction V'. Thus, first pane 212A may be positioned below the pair of matched pocket handle openings 262, 264 along a vertical direction V', and second pane 212B may be positioned above the pair of matched pocket handle openings 262, 264 along the vertical direction V'. Spacer bodies 268 may define or bound pocket handle openings 262, 264 on opposite lateral sides. Together, pocket handle openings 262, 264 may define a common profile (e.g., in a plane perpendicular to transverse direction T') to permit a user's hand to pass therethrough. Thus, the matched pocket handle openings 262, 264 may permit a user to grasp and rotate door 116. Notably, the rotation is permitted without requiring a protruding handle member.

Figure 10:
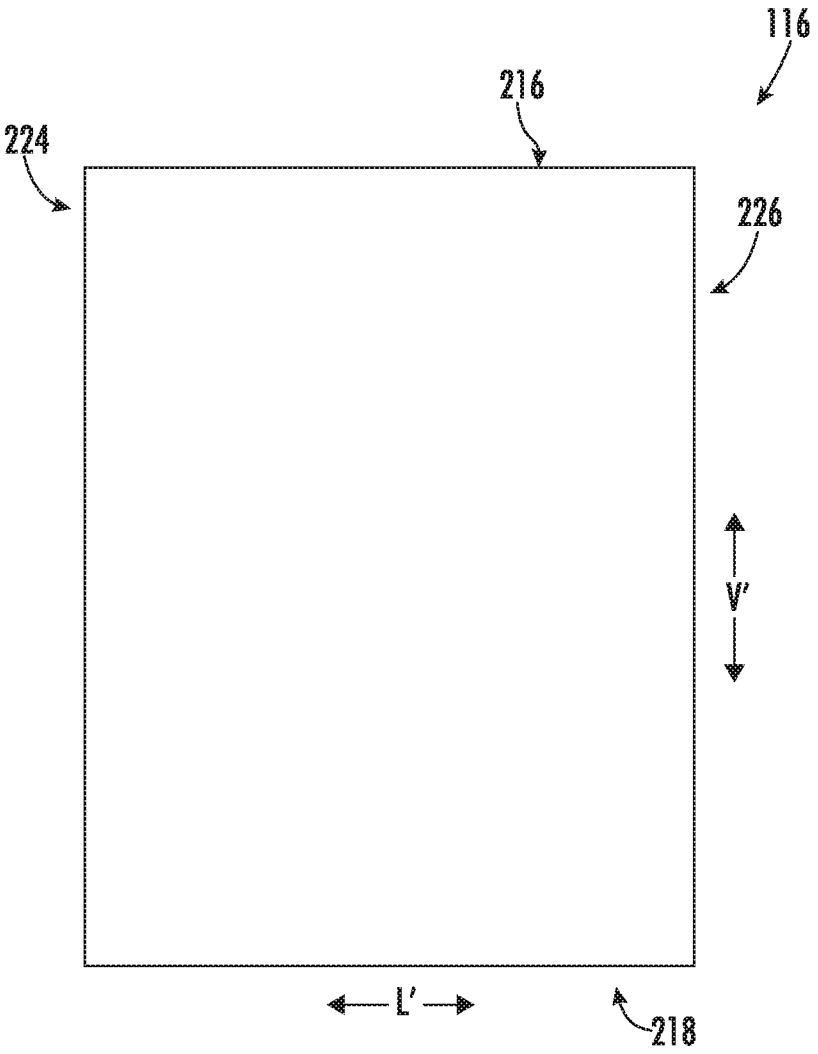
FIG. 10 provides a front perspective view of the exemplary dishwasher door of FIG. 9.
Figure 9:
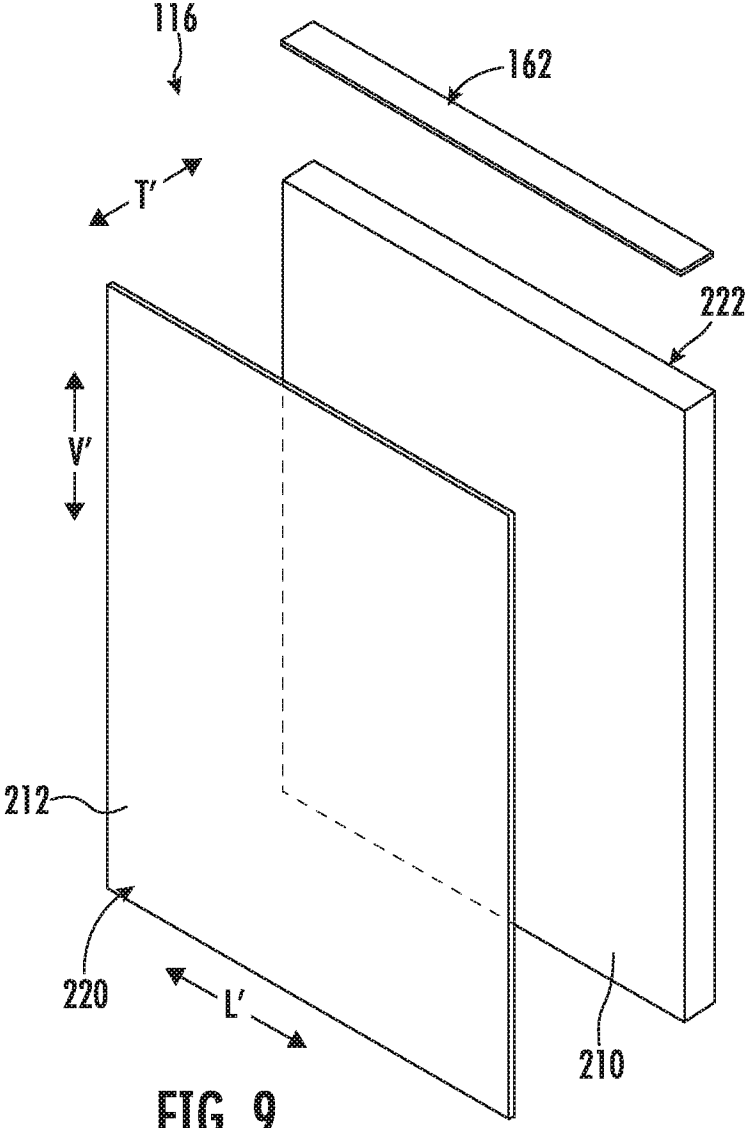
FIG. 9 provides an exploded view of a dishwasher door according to exemplary embodiments of the present disclosure.

Turning now to FIGS. 9 and 10, various views of door 116 according to yet other exemplary embodiments are illustrated. Except as otherwise indicated, it is understood that the embodiments of FIGS. 9 and 10 may include all or some of the features of the embodiments described above with respect to FIGS. 1 through 8. For example, external panel 212 may be a single integral pane or member (e.g., a single monolithic glass panel) that extends uninterrupted across the internal panel from the top end 216 to the bottom end 218 and from the first lateral end 224 to the second lateral end 226. Thus, the single integral pane or member may be substantially solid (such that water is prevented from passing therethrough) and free from any visible opening. One or more push-to-open latches (not pictured) may be mounted to cabinet 102 (FIG. 2) to alternately secure and release door 116 in the closed position. Notably, rotation between the open position and closed position is permitted without requiring a protruding handle member.

Figure 11:
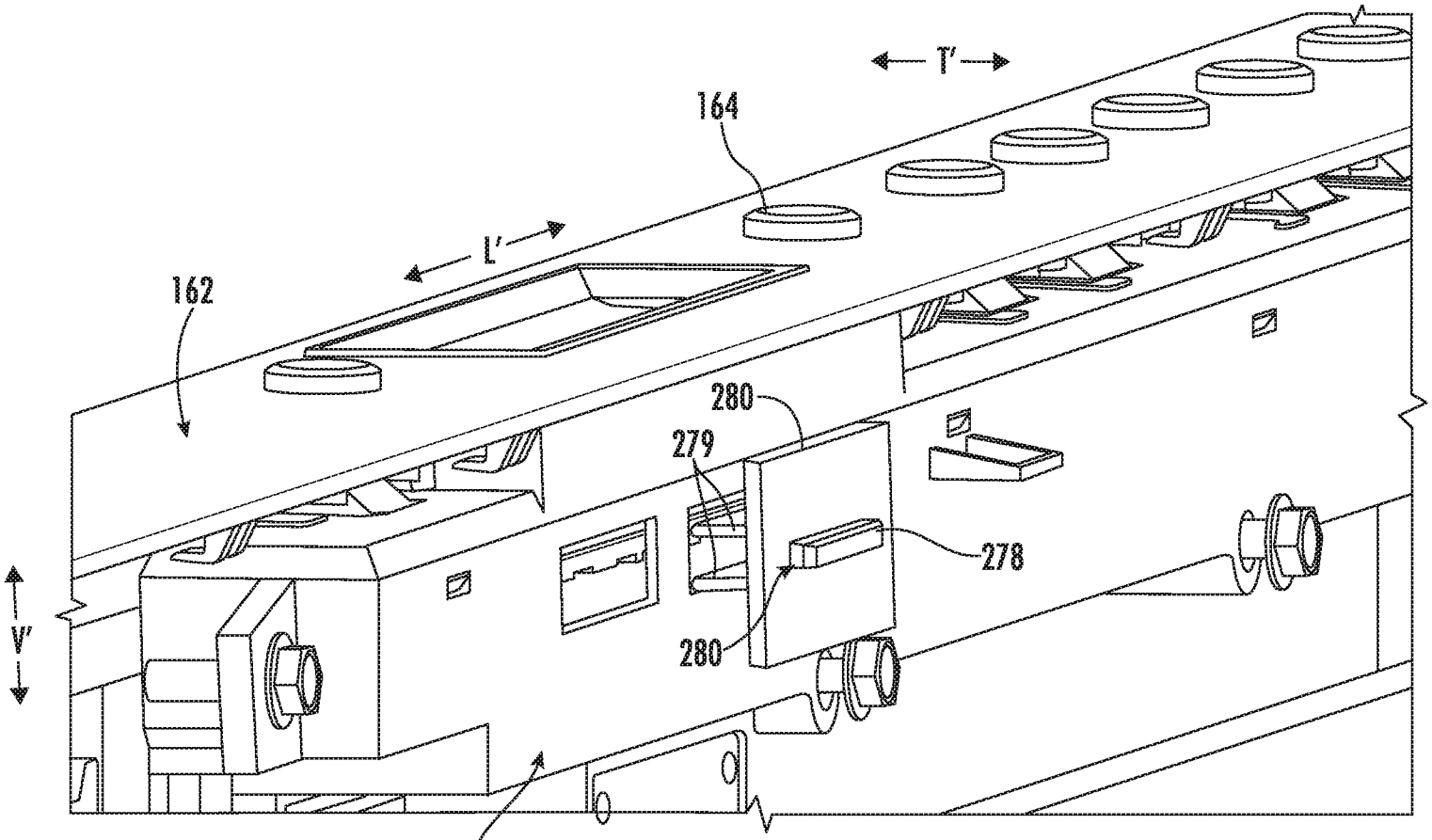
FIG. 11 provides a perspective view of a top portion of a door according to exemplary embodiments of the present disclosure, wherein various components have been removed for the sake of clarity.
Figure 12:
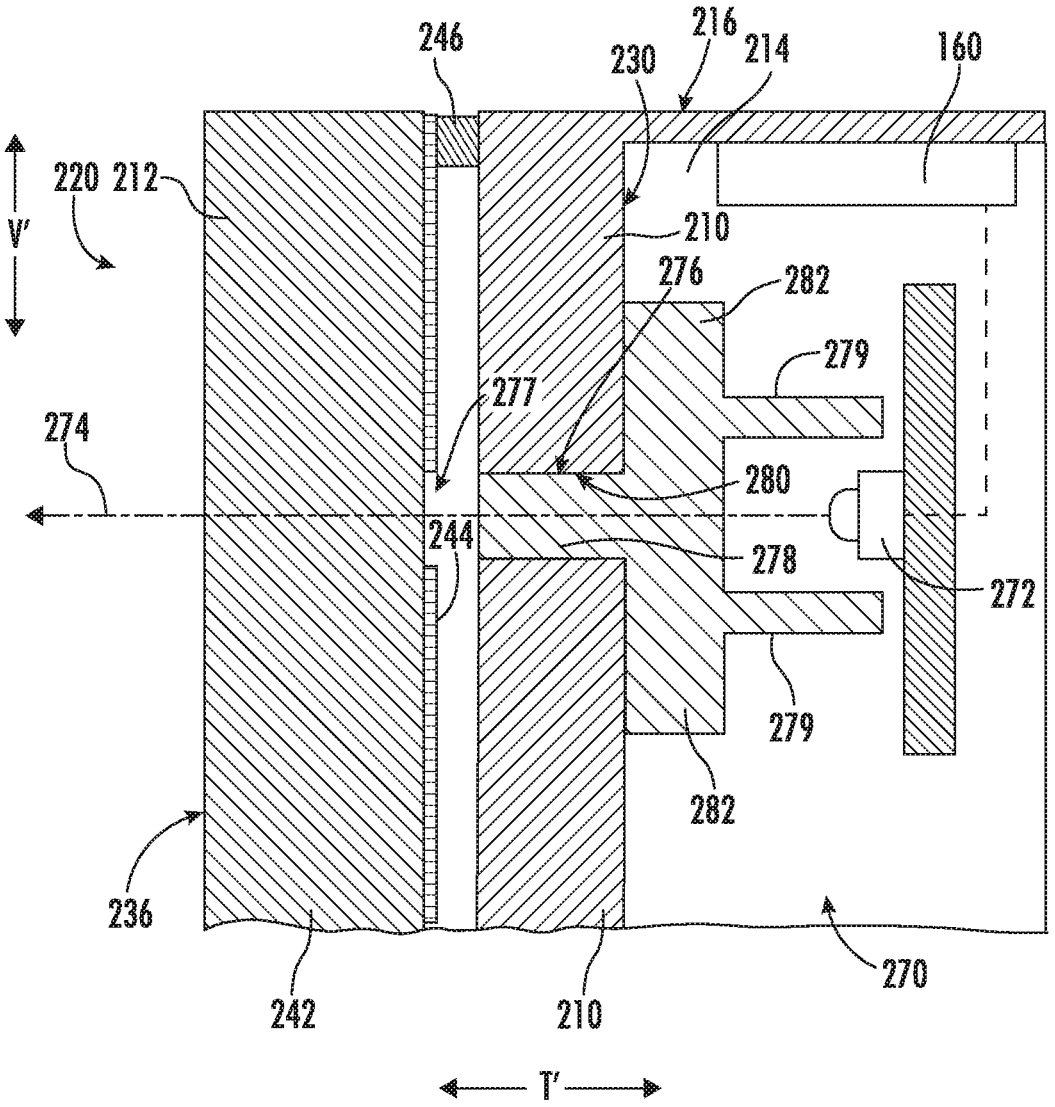
FIG. 12 provides a cross-sectional side view of a top portion of a door according to exemplary embodiments of the present disclosure.

As shown in FIGS. 11 and 12, some embodiments include a lighting assembly 270 within door 116. For instance, lighting assembly 270 may be positioned at or adjacent top end 216 of door 116 (e.g., beneath user interface or control panel 164). For instance, one or more light sources 272 may be positioned proximal to top end 216 and directed toward external panel 212 such that light emissions 274 may be projected through door 116 and presented forward therefrom (e.g., to a user in front of dishwasher appliance 100—FIG. 2). For instance, a light source 272 may be positioned behind internal panel 210 (e.g., along the transverse direction T') or within inner frame 214.

As described above, controller 160 may be operably connected to the light source 272. Moreover, controller 160 may be configured to selectively activate light source 272, for instance, based on a cycle status of the dishwashing appliance 100. Thus, lighting assembly 270 may provide an easily-viewed visual indication of the state of dishwashing appliance 100 (e.g., even when a portion of control panel is covered by a counter or table surface beneath which dishwasher appliance 100 is installed).

Generally, light source 272 may be any suitable electric light-generating source, such as, for instance, a light-emitting diode (LED). Optionally, light source 272 may be configured to vary the color of light emissions 274. For instance, one or more of the LEDs may be provided as a multi-color diode. Each multi-color diode may include distinct red, green, and blue elements to selectively vary the visible color of light emissions 274 projected from light source 272. In some such embodiments, controller 160 is further configured to alter a color of the light emission 274 based on the cycle status. For instance, one color of light emission 274 (e.g., yellow or red) may indicate a wash cycle is pending, while another visually-distinct color (e.g., green) may indicate that the wash cycle is complete. In additional or alternative embodiments, one or more of the LEDs may be configured to emit light emissions 274 of a single visible color.

In some embodiments, one or more light channels 276 are defined through internal panel 210 (e.g., along the transverse direction T' from the inner face 230 to the outer face 232). As shown, a light channel 276 may be defined proximal to top end 216 and directed toward external panel 212. In certain embodiments, light channel 276 is positioned above a handle portion of door 116 (e.g., along the vertical direction V'). For instance, as illustrated in FIG. 1, light channel 276 may be defined above matched pocket handle openings 262, 264. Additionally or alternatively, light channel 276 may be positioned above a protruding handle (not pictured) mounted to and extending outward from external panel 212.

Each light channel 276 may be open to permit light emissions 274 therethrough. Moreover, light source 272 may be positioned behind internal panel 210 (e.g., within inner frame 214) and directed at light channel 276 (e.g., in transverse alignment therewith). The solid forward surface or area of external panel 212 may cover light channel 276. Notably, the area of external panel 212 directly in front of light channel 276 (e.g., along the transverse direction T') may be substantially solid or smooth. In some embodiments including opaque coating 244 on external panel 212, opaque coating 244 may define a visual aperture 277 that is aligned with external panel (e.g., along the transverse direction T'). Optionally, the visual aperture 277 may be provided by a void or opening in opaque coating 244 (e.g., along the transverse direction T'). Additionally or alternatively, visual aperture 277 may be provided as a transparent or translucent material portion of opaque coating 244 (e.g., as a separate semi-transparent coating to opaque coating 244 such that a blended surface is created across the visual aperture 277). Thus, light emissions 274 may pass through the corresponding area of external panel 212 while fluid and moisture may be prevented from flowing through the same. Moreover, light source 272 may be visually hidden or covered behind internal panel 210. Advantageously, lighting assembly 270 may provide a dead-fronted visual indicator or display, which is hidden or obscured while not in use.

It is noted that although light channels 276 are shown as having a rectangular shape or profile (e.g., in a plane perpendicular to the transverse direction T'), any suitable shape may be provided. For instance, one or more light channels 276 may be formed in the shape of letters or text that may intuitively indicate the status of dishwasher appliance 100 when light emissions 274 are transmitted therethrough.

As shown, especially in FIG. 11, a light guide 278 may extend through the light channel 276. The light guide 278 may include or be formed from a substantially transparent or translucent material (e.g., acrylic) mounted within internal panel 210 (e.g., from inner face 230 to outer face 232). Light guide 278 may thus direct light emissions 274 from light source 272 and through light channel 276. In certain embodiments, light guide 278 has a shape or profile that complements the shape of the light channel 276 through which it extends. For instance, a perimeter or profile of a radial wall surface 280 of the light guide 276 may be substantially similar to the profile of light channel 276. In turn, the radial wall surface 280 may mirror or abut the portion of internal panel 210 that defines light channel 276. Optionally, light guide 278 may be flush with the outer face 232 of internal panel 210 (e.g., along the transverse direction T'). Alternatively, light guide 278 may extend beyond the outer face 232 along the transverse direction T' (i.e., in closer proximity to external panel 212 than a flush embodiment).

In certain embodiments, one or more containment walls 279 extend from light guide 278 (e.g., integrally therewith). As illustrated, containment walls 279 may extend inward (e.g., rearward along the transverse direction T') away from internal panel 210 and into inner frame 214. Moreover, containment walls 279 may be positioned around (e.g., above or below) light source 272, guiding emissions 274 to light guide 278 and preventing light emissions 274 from traveling from door 116 along a path other than light channel 276. Additionally or alternatively, a restriction wall 282 may extend from light guide 278 (e.g., integrally therewith). When assembled, restriction wall 282 may thus extend outward (e.g., along the lateral direction L' or vertical direction V') from light guide 278 within inner frame 214 and have a shape or profile larger than that of light channel 276. As shown, restriction wall 282 may be positioned behind internal panel 210 and, optionally, abut inner face 230. Moreover, restriction wall 282 may be positioned in front of light source 272 and block or restrict inadvertent emissions to light guide 278.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher door extending in a lateral direction from a first end to a second end, the dishwasher door comprising:
- an inner frame;
- an internal panel attached to the inner frame and defining an inner face and an outer face, the internal panel defining a light channel along a transverse direction from the inner face to the outer face;
- an external panel extending across the internal panel in front of the light channel, the external panel defining an inner face directed toward the outer face of the planner internal panel;
- a light source positioned behind the internal panel within the inner frame, the light source being directed at the light channel to transmit a light emission therethrough;
- an opaque coating disposed across the external panel, the opaque coating defining a visual aperture aligned with the light channel along the transverse direction;
- a light guide extending through the light channel; and
- one or more containment walls extending rearward from the light guide and integrally therewith, the one or more containment walls extending within the inner frame around the light source to guide the light emission to the light channel.

2. The dishwasher door of claim 1, wherein the external panel comprises a glass material.

3. The dishwasher door of claim 1, wherein the opaque coating is disposed on the inner face of the external panel.

4. The dishwasher door of claim 1, wherein the external panel comprises an optically transparent pane.

5. The dishwasher door of claim 1, wherein the outer face of the external panel defines an outermost surface of the door along the transverse direction.

6. The dishwasher door of claim 1, further comprising a controller operably connected to the light source, the controller being configured to activate the light source based on a cycle status of the dishwashing appliance.

7. The dishwasher door of claim 6, wherein the controller is further configured to alter a color of a light emission from the light source based on the cycle status.

8. The dishwasher door of claim 1, further comprising a user input extending above the internal panel and the external panel.

9. A dishwasher door extending in a lateral direction from a first end to a second end, the dishwasher door comprising:
- an inner frame;
- an internal panel attached to the inner frame and defining an inner face and an outer face, the internal panel defining a light channel at an upper portion of the door, the light channel extending along a transverse direction from the inner face to the outer face;
- an external panel extending across the internal panel in front of the light channel, the external panel defining an inner face directed toward the outer face of the planner internal panel;
- a light source positioned within the inner frame behind the internal panel, the light source being directed at the light channel to transmit a light emission therethrough;
- a light guide extending through the light channel;
- an opaque coating disposed across the external panel, the opaque coating defining a visual aperture aligned with the light channel along the transverse direction; and
- one or more containment walls extending rearward from the light guide and integrally therewith, the one or more containment walls extending within the inner frame around the light source to guide the light emission to the light channel.

10. The dishwasher door of claim 9, wherein the guide extends to the outer face of the internal panel.

11. The dishwasher door of claim 9, wherein the external panel comprises a glass material.

12. The dishwasher door of claim 9, wherein the opaque coating is disposed on the inner face of the external panel.

13. The dishwasher door of claim 9, wherein the external panel comprises an optically transparent pane.

14. The dishwasher door of claim 9, wherein the outer face of the external panel defines an outermost surface of the door along the transverse direction.

15. The dishwasher door of claim 9, further comprising a controller operably connected to the light source, the controller being configured to activate the light source based on a cycle status of the dishwashing appliance.

16. The dishwasher door of claim 9, wherein the controller is further configured to alter a color of a light emission from the light source based on the cycle status.

17. The dishwasher door of claim 9, further comprising a user input extending above the internal panel and the external panel.

* * * * *